US011305525B2

(12) United States Patent
Wong et al.

(10) Patent No.: US 11,305,525 B2
(45) Date of Patent: Apr. 19, 2022

(54) PRINT SUBSTANCE RESERVOIRS

(71) Applicant: Hewlett-Packard Development Company, L.P., Spring, TX (US)

(72) Inventors: Howard G Wong, Vancouver, WA (US); Wesley R Schalk, Vancouver, WA (US); Kris R Livingston, Boise, ID (US); Duane A Koehler, Vancouver, WA (US); Kenneth Williams, Vancouver, WA (US); Tyler Kapp, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 3 days.

(21) Appl. No.: 17/049,139

(22) PCT Filed: Jul. 13, 2018

(86) PCT No.: PCT/US2018/042102
§ 371 (c)(1),
(2) Date: Oct. 20, 2020

(87) PCT Pub. No.: WO2020/013862
PCT Pub. Date: Jan. 16, 2020

(65) Prior Publication Data

US 2021/0252849 A1 Aug. 19, 2021

(51) Int. Cl.
*B41J 2/175* (2006.01)
*B41F 31/02* (2006.01)

(52) U.S. Cl.
CPC ..... *B41F 31/02* (2013.01); *B41J 2/17506* (2013.01); *B41J 2/17546* (2013.01)

(58) Field of Classification Search
CPC .... B41J 2/175; B41J 2/17506; B41J 2/17509; B41J 2/17523; B41J 2/17546; B41F 31/02
See application file for complete search history.

(56) References Cited

U.S. PATENT DOCUMENTS 6,945,640 B2 9/2005 Cheok
7,097,291 B2 8/2006 Silverbrook
(Continued)

FOREIGN PATENT DOCUMENTS

CN 1157214 8/1997
CN 101269586 9/2008
(Continued)

OTHER PUBLICATIONS

Brother refillable cartridges, LC123, LC 125, LC127 how to fill ~ 3 pages ~ date unknown.

*Primary Examiner* — Anh T Vo
(74) *Attorney, Agent, or Firm* — HP Inc. Patent Department

(57) ABSTRACT

An example printing device may comprise an indicator to convey information to a user, a print substance reservoir to house a print substance, where the print substance reservoir is communicatively coupled to a fill port, a sensor to determine when a refill container is connected to the fill port, a processing resource, and a non-transitory machine-readable medium storing instructions executable by the processing resource to transmit signals to the indicator responsive to an indication that the sensor has detected the refill container connected to the fill port, where the signals correspond to the information to be conveyed by the indicator, and authenticate the refill container.

15 Claims, 5 Drawing Sheets

(56) References Cited

U.S. PATENT DOCUMENTS

| | | | | |
|---|---|---|---|---|
| 7,566,106 | B2 | 7/2009 | Silverbrook | |
| 7,866,801 | B2 | 1/2011 | Ishizawa et al. | |
| 9,586,405 | B2 | 3/2017 | Iwamuro | |
| 9,610,775 | B2 | 4/2017 | Yanagida et al. | |
| 2001/0019665 | A1 | 9/2001 | Kawakami | |
| 2005/0034777 | A1 | 2/2005 | Nicodem et al. | |
| 2005/0157037 | A1 | 7/2005 | Silverbrook et al. | |
| 2008/0097770 | A1* | 4/2008 | Low | B41J 2/17509 705/304 |
| 2011/0131441 | A1* | 6/2011 | Asauchi | B41J 2/17523 713/501 |
| 2011/0208991 | A1* | 8/2011 | Sato | G06K 15/102 713/600 |

FOREIGN PATENT DOCUMENTS

| | | | |
|---|---|---|---|
| CN | 202088665 | | 12/2011 |
| CN | 102371772 | | 3/2012 |
| GB | 2495267 | | 4/2013 |
| JP | 2011168002 | A | 9/2011 |
| TW | 201425060 | | 7/2014 |
| WO | WO-0228654 | | 4/2002 |
| WO | WO-2010027470 | A3 | 4/2010 |
| WO | WO-20140134962 | W | 9/2014 |
| WO | WO-2015016857 | A1 | 2/2015 |
| WO | WO-2016171694 | A1 | 10/2016 |

* cited by examiner

PRINT SUBSTANCE RESERVOIRS

BACKGROUND

Imaging systems, such as printers, copiers, etc., may generate text, images, and/or objects on a print medium (e.g., paper, plastic, a bed of build material in the case of Three-Dimensional (3D) printing, etc.). For instance, imaging systems may print text and/or graphics by transferring a print substance (e.g., ink, toner, binding agent, etc.) to a print medium.

DETAILED DESCRIPTION

A printing device may include a print substance reservoir. The print substance reservoir may contain a print substance. The print substance may be used to produce text and/or graphics, etc. on a print medium. The print substance reservoir may be coupled to a fill port to allow the transfer of a print substance into and/or out of the print substance reservoir. A refill container may be connected to the fill port to refill the print substance reservoir by transferring print substance to the print substance reservoir. However, error and/or confusion may result during the refill process, if the user does not receive interactive feedback and/or instructions during the refill process. For instance, absent interactive feedback and/or instructions a user may incorrectly connect a refill container to fill port, spill the print substance, and/or refill the print substance reservoir with a print substance of an incorrect color, etc. Moreover, such errors may occur without the printing device being aware of the errors and thereby impart additional errors. As used herein, "feedback" may refer to information and/or assistance based on and/or in response to an action.

As such, print substance reservoirs, as described herein, provide interactive feedback and instructions during a refill process. For example, feedback may be provided through the use of audio, visual, and/or haptic feedback to assist the user during a refill process. In some examples, instructions may be provided through an audio mechanism and a visual mechanism to provide the user with sequential instructions during a refill process. Accordingly, this detailed description describes print substance reservoirs that provides instructions and feedback to a user to create a simple, interactive, and error free refill process. In some examples, the print substance reservoir may include a sensor to determine when the refill container, holding print substance, is connected to the fill port. In some examples, the print substance reservoir may include an indicator to covey instructions to a user during the refill process. That is, the indicator may provide feedback to the user during the process of transferring print substance from a refill container to the print substance reservoir.

Figure 1:
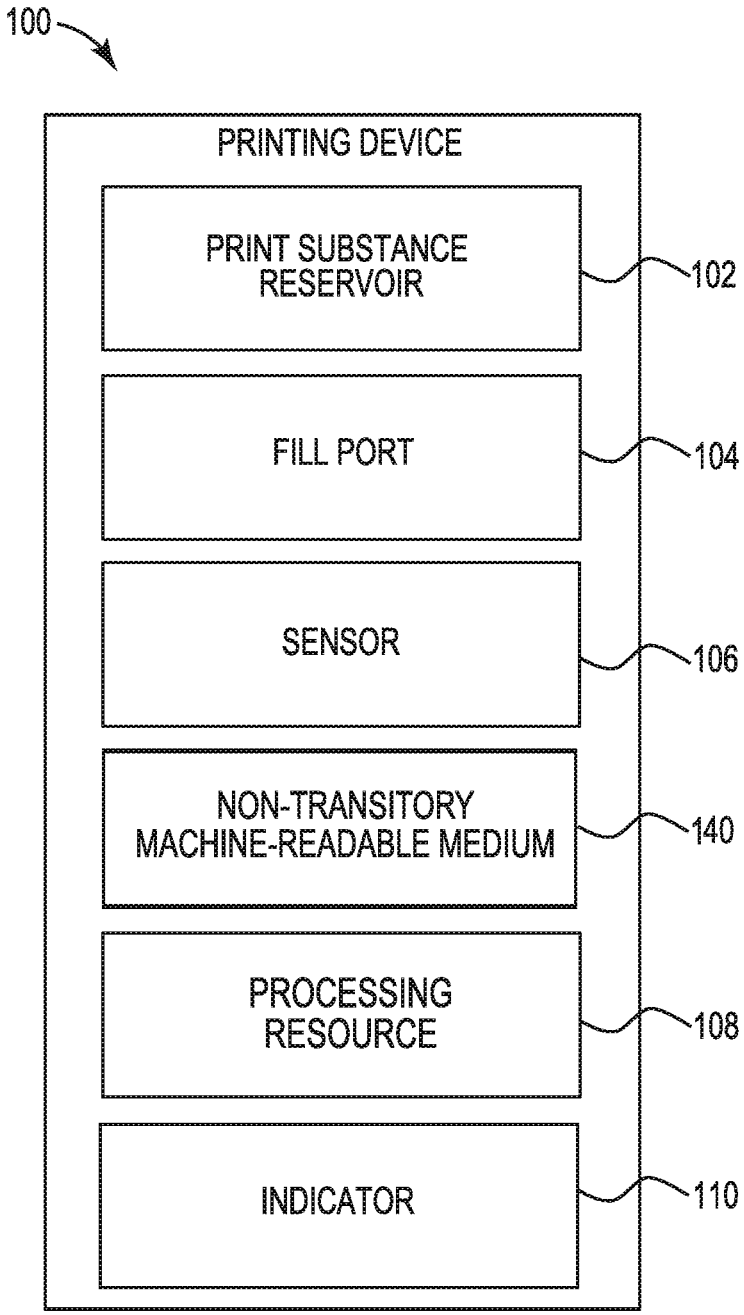
FIG. 1 illustrates an example printing device including a print substance reservoir.

FIG. 1 illustrates an example printing device 100 including a print substance reservoir 102. The print substance reservoir may be implemented in a variety of imaging systems, such as printers, copiers, etc., for example. In some examples, the printing device 100 may include a print substance reservoir 102 to house the print substance. In some examples, the print substance reservoir 102 may be refilled when the amount of print substance in the print substance reservoir 102 is not at capacity. As used herein, "capacity" may refer to the maximum amount an object can contain. In some examples, the print substance reservoir 102 may be coupled to the fill port 104. It should be understood that when an element is referred to as being "connected to" or "coupled to" another element, it may be directly connected, or coupled with the other element or intervening elements may be present. In some examples, the print substance reservoir 102 may be communicatively coupled to a fill port 104. That is, the fill port 104 may be coupled to the print substance reservoir 102 in a manner that allows print substance to enter and exit the print substance reservoir 102 through the fill port 104. As used herein, "communicatively coupled" may refer to a connection between devices such that data and/or print substance may be transferred in various directions between the devices.

In some examples, the fill port 104 may connect to a refill container. In some examples, the fill port 104 may connect to a refill container to transfer print substance to the print substance reservoir 102. That is, when the amount of print substance in the print substance reservoir 102 is not at capacity the refill container may connect to the fill port 104 to transfer print substance from the refill container to the print substance reservoir 102. In some examples, the print substance reservoir 102 may include a seal that covers the fill port 104. In some examples, the seal may be used to prevent print substance from spilling out of the print substance reservoir 102 and/or extending the life of the print substance in the print substance reservoir 102. In some examples, the seal may prevent contamination of the print substance in the print substance reservoir 102, prevent the loss and/or evaporation of the print substance in the print substance reservoir 102, and/or prevent a change in the print substance in the print substance reservoir 102 that may result in degraded print functionality. In some examples, the seal may be removed to allow the refill container to connect to the fill port 104. As used herein, "seal" may refer to a device that protects the print substance in the print substance reservoir from the outside elements and/or prevents spilling of print substance in the print substance reservoir. For example, a seal may include a poppet valve, a shutter door, a cover, etc.

In some examples, the fill port 104 may be connected to a sensor 106. As used herein, "sensor" may refer to an electronic device to detects and/or measures the properties of the printing device and/or refill container. In some examples, the sensor 106 may detect when the seal is in an open position. For example, the sensor may detect when the fill port 104 is no longer covered by the seal. Similarly, the sensor 106 may detect when the seal is in a closed position. In some examples, detecting when the seal is in an open position and a closed position may allow the printing device 100 to provide feedback to a user during a refill process. As used herein, "refill process" may refer to the process of adding print substance to the print substance reservoir. In some example, the sensor 106 may detect when a refill container is connected to the fill port 104. That is, detecting when a refill container is connected to the fill port 104 may allow the printing device 100 to inform a user if the refill container is properly connected to the fill port 104. In some examples, the sensor 106 detecting when the refill container is connected to the fill port 104 may prevent spilling of print substance. For example, the refill process may not initiate until the sensor 106 detects that the refill container is properly connected, preventing spilling of print substance. That is, the sensor 106 detecting when the refill container is connected to the fill port 104 may reduce user error during the refill process.

In some examples, the printing device 100 may include a non-transitory machine-readable medium 140 storing instructions executable by a processing resource 108. In some example, the medium 140 may include instructions executable by processing resource 108 to transmit signals to an indicator 110 such as those to provide feedback to a user during the refill process. As used herein, "indicator" may refer to a device that provides feedback to a user utilizing a light source, a display screen, an audio mechanism, a vibration mechanism to provide haptic feedback and/or other forms of audio-visual feedback. In some examples, the medium 140 may include instructions executable by processing resource 108 to transmit signals to the indicator 110 when the sensor detects the refill container is properly connected to the fill port 104. That is, once the refill container is properly connected and/or seated into the fill port 104, the medium 140 may include instructions executable by processing resource 108 to send signals to the indicator 110 to provide the user with feedback. In some examples, providing feedback via an indicator 110 may guide a user through the refill process and reduce the amount of errors during the refill process. For example, providing feedback may prevent spilling of print substance during the refill process, ensure the print substance reservoir 102 is refilled with the correct print substance, correct user error, anticipate user action during the refill process, and interact with the user to provide guidance and instruction during the refill process. As used herein, "guidance" may refer to feedback and/or instructions provided to perform a particular task pertaining to the transfer of a print substance into and/or out of the print substance reservoir.

In some examples, the medium 140 may include instructions executable by processing resource 108 to receive a refill container information from a memory device included in the refill container. As used herein, "refill container information" may refer to information about the refill container and the print substance in the refill container. That is, the refill container information may include information such as, an amount of print substance in the refill container, a type or brand of print substance in the refill container, the color of the print substance in the refill container, the age of the print substance in the refill container, the region the print substance in the refill container is to be used in, the seller and manufacturer of the refill container, etc.

In some examples, the memory device is used to authenticate the refill container. That is, the memory device may include refill container information that may inform the printing device 100 if the refill container is using unauthorized print substance to refill the print substance reservoir 102. As used herein, "authenticate" may refer to the act of verifying a product is approved for use with the printing device. For example, if it is determined that a refill container is an approved refill container for the printing device 100 the refill container has been authenticated and may be used to refill the print substance reservoir 102.

In some examples, if the processing resource 108 determines that the refill container is using unauthorized print substance to refill the print substance reservoir 102, the refill process may not initiate. For example, a refill container may be unauthorized if the processing resource 108 determines that the print substance in the refill container is expired, the amount of print substance in the container is more than what is recorded on the memory device, etc. As used herein, "unauthorized" may refer to an object that does not have permission and/or approval to be used with the printing device and/or fill port. For example, if it is determined that the refill container contains more print substance than what is stated in the refill container information, as sent by the memory device, the refill container may not have permission and/or approval to be used with the printing device 100 and/or fill port 104. As used herein, "memory device" may refer to a device that may include information related to the container to which it is connected and information related to the containers content. For example, the memory device may be attached to a refill container and include information related to the contents, manufacturing etc. of the refill container. The medium 140 may include instructions executable by processing resource 108 to receive refill container information from the memory device when the refill container connects to the fill port 104.

In addition, if the processing resource determines that the refill container is using authorized print substance to refill the print substance reservoir 102, then the refill process may initiate. As used herein, "authorized" may refer to an object that has permission and/or approval to be used with the printing device and/or fill port. In some examples, the processing resource 108 may determine if the refill container is compatible with the print substance reservoir 102. For example, the processing resource 108 may use the refill container information to determine if the refill container is designed for use with the printing device 100.

In some examples, receiving refill container information may allow the processing resource 108 to authenticate the refill container. In some examples, authenticating the refill container may prevent a user from refilling the print substance reservoir with expired print substance. In addition, authenticating the refill container may prevent theft by reducing the use of unauthorized refill containers during the refill process. In some examples, the medium 140 may include instructions executable by processing resource 108 to authenticate the refill container with the received refill container information to determine if the refill container is an approved refill container. In some examples, the medium 140 may include instructions executable by processing resource 108 to update the refill container information after the transfer of print substance is complete. In some examples, the medium 140 may include instructions executable by processing resource 108 to receive refill container information from the memory device and compare the refill container information from the memory device with network information, for the same refill container. As used herein, "network information" may refer to information from a network about the refill container and the print substance in the refill container. In some examples, the refill container may not be an approved refill container if the network information for the refill container does not match the refill container information. In some examples, the processing resource 108 may update the network information after the transfer of print substance is completed.

Figure 2:
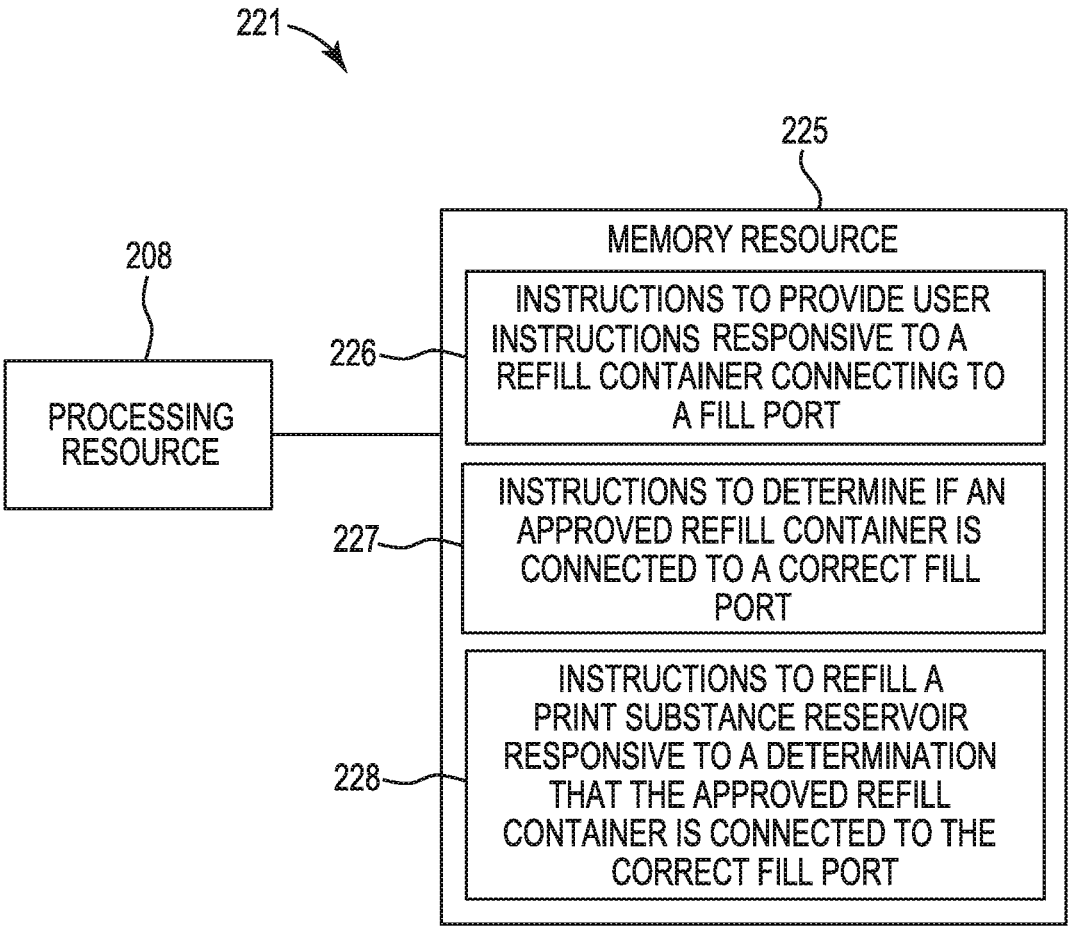
FIG. 2 illustrates an example processing resource and an example memory resource of an example apparatus including a print substance reservoir.

FIG. 2 illustrates an example processing resource 208 and an example memory resource 225 of an example apparatus 221 including a print substance reservoir. As illustrated in FIG. 2, the apparatus 221 includes a processing resource 208 and a memory resource 225. The processing resource 208 may be a hardware processing unit such as a microprocessor, application specific instruction set processor, coprocessor, network processor, or similar hardware circuitry that may cause machine-readable instructions to be executed. In some examples, the processing resource 208 may be a plurality of hardware processing units that may cause machine-readable instructions to be executed. The processing resource 208 may include central processing units (CPUs) among other types of processing units. The memory resource 225 may be any type of volatile or non-volatile memory or storage, such as random-access memory (RAM), flash memory, read-only memory (ROM), storage volumes, a hard disk, or a combination thereof.

The memory resource 225 may store instructions thereon, such as instructions 226, 227, and 228. When executed by the processing resource 208, the instructions may cause the apparatus 221 to perform specific tasks and/or functions. For example, the memory resource 225 may store instructions 226 which may be executed by the processing resource 208 to cause the apparatus 221 to provide user feedback responsive to a refill container connecting to a fill port. In some examples, providing user feedback may assist the user in the refill process. That is, the user feedback may provide sequential instructions on how to properly refill the print substance reservoir. In some examples, the user feedback may include haptic feedback from a vibration mechanism, visual feedback from a light source or display screen (e.g., written feedback, video feedback, graphic feedback, etc.), and/or audio feedback from an audio mechanism.

The memory resource 225 may store instructions 227 which may be executed by the processing resource 208 to cause the apparatus 221 to determine if an approved refill container is connected to a correct fill port. In some examples, refilling the print substance reservoir with unauthorized print substance may produce poor quality images on print medium and/or cause damage to the printing device. The apparatus 221 may provide user feedback to inform the user if the print substance in the refill container is authorized for the apparatus 221. If the print substance is not authorized for the apparatus 221, the refill process may not initiate. However, if the print substance is authorized for the apparatus 221 the refill process may initiate. As used herein, "approved refill container" may refer to a refill container connected to the proper fill port and containing authorized print substance.

In addition, the apparatus 221 may determine if the color of the print substance in the refill container is the same as the color of print substance in the print substance reservoir. If the color of the print substance in the refill container is not the same as the color of the print substance in the reservoir, the refill process may not initiate. In addition, the apparatus 221 may provide feedback to indicate the refill container is not approved for the particular fill port it is attached to and provide instructions on how to correct the error. Conversely, if the color of the print substance in the refill container is the same as the color of the print substance in the reservoir, the refill process may initiate. In addition, the apparatus 221 may provide feedback informing the user that the refill container is approved for the fill port and provide instruction on how to continue the refill process.

The memory resource 225 may store instructions 228 which may be executed by the processing resource 208 to cause the apparatus 221 to refill a print substance reservoir responsive to a determination that the approved refill container is connected to the correct fill port. In some examples, when an approved refill container is connected to the correct fill port the refill process may initiate. In some examples, allowing the refill process to initiate when an approved refill container is connected to the correct fill port may ensure that the correct print substance color is used to refill the print substance reservoir, prevent the use of unauthorized print substance in the refill process, provide an error free refill process, etc.

Figure 3:
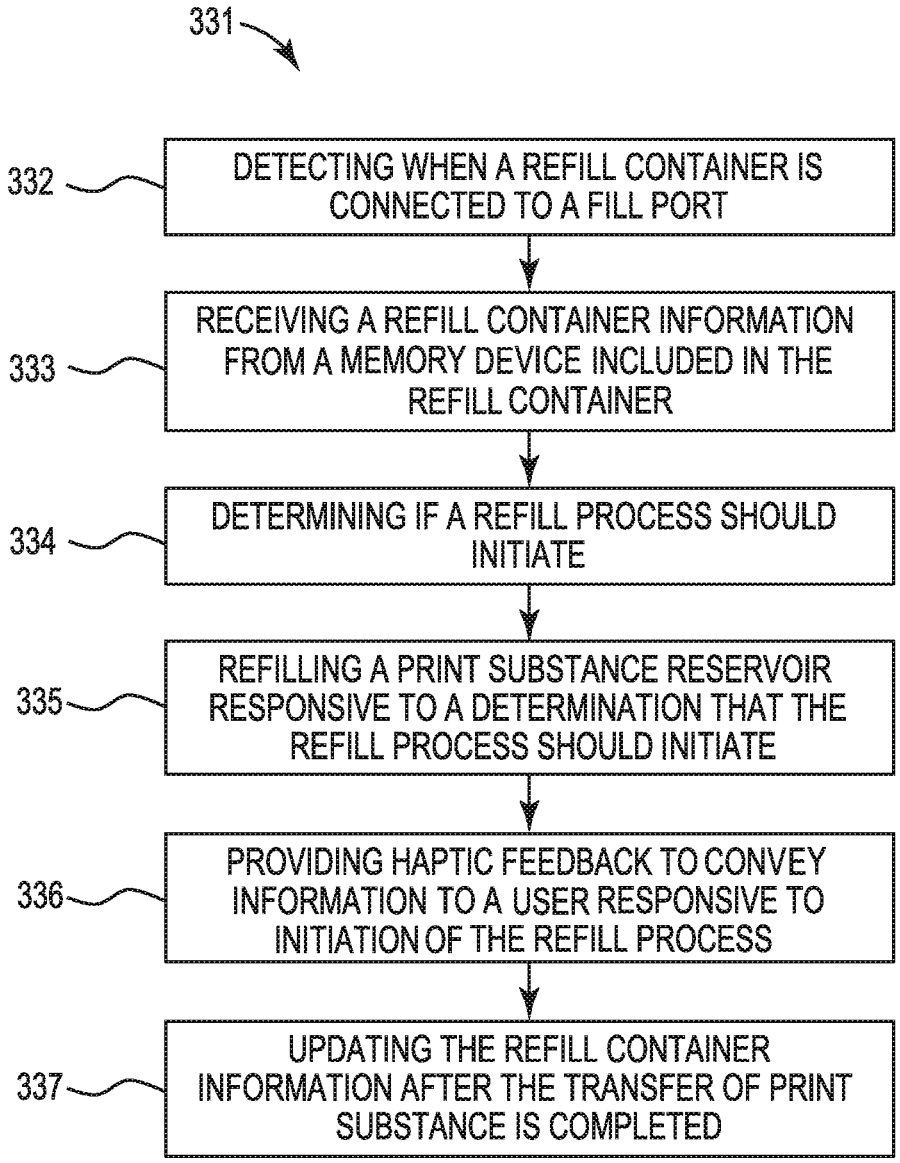
FIG. 3 illustrates an example method to a print substance reservoir.

FIG. 3 illustrates an example method 331 to a print substance reservoir. Method 331 may be performed, for example, by a processing resource (e.g., processing resource 108, described in FIG. 1) of a printing device (e.g., printing device 100, described in FIG. 1). Method 331 may be repeated each time a refill container is connected to a fill port.

At 332, the method 331 may include detecting, by a processing resource, when a refill container is connected to a fill port. When the seal of the print substance reservoir is open, the printing device may anticipate the connection of a refill container to the fill port and provide instruction on how to connect the refill container to the fill port. Once the processing resource detects a refill container connected to the fill port, the user may receive feedback to guide the refill process. The processing resource may then determine if the refill container is properly connected and/or seated in the fill port. That is, if the refill container is not properly connected to the fill port, the processing resource may detect that the refill container is not completely connected to the fill port and user feedback may be sent to an indicator to inform the user that the refill container is not completely connected to the fill port. Once the processing resource detects the refill container is connected to the fill port the memory device included in the refill container may be read.

At 333, the method 331 may include receiving, by the processing resource, a refill container information from a memory device included in the refill container. The processing resource may receive refill container information when the processing resource detects that the refill container is connected to the fill port. With the refill container information, the processing resource may authenticate the refill container and determine if the refill container is an approved refill container. That is, the processing resource may determine if the print substance in the refill container should be used in the refill process. In some examples, the processing resource may connect to a network to authenticate the refill container and determine if the refill container is an approved refill container.

At 334, the method 331 can include determining, by the processing resource, if a refill process should initiate. In some examples, the processing resource may determine if a refill process should initiate by determining if the refill container is an approved refill container. If the refill container is an approved refill container the processing resource may initiate a refill process. However, if it is determined that the refill container is not an approved refill container the refill process may not initiate. That is, the processing resource may determine if the refill process should initiate based on authentication of the refill container using the refill container information.

At 335, the method 331 can include refilling, by the processing resource, a print substance reservoir responsive to a determination that the refill process should initiate. In some examples, once it is determined that the refill container is an approved refill container that is properly connected to the fill port the print substance may be transferred from the refill container to the print substance reservoir.

At 336, the method 331 can include providing, by the processing resource, haptic feedback to convey information to a user responsive to initiation of the refill process. In some examples, the processing resource may provide feedback to convey information to the user during the refill process. The feedback may include haptic feedback. For example, the processing resource may provide haptic feedback when the user properly connects the refill container to the fill port. In some examples, the processing resource may provide haptic feedback when print substance is being transferred from the refill container to the print substance reservoir.

At 337, the method 331 can include updating, by a processing resource, the refill container information after the transfer of print substance is completed. In some examples, after the print substance is transferred from the refill container to the print substance reservoir the processing resource may update refill container information. For example, the processing resource may update the amount of print substance remaining in the refill container. In some examples, updating the amount of print substance remaining in the refill container may keep a record of how much print substance is in a refill container. For example, if print substance is added to a refill container and connected to the fill port the processing resource may authenticate the refill container. The processing resource may determine that a refill process should not initiate because the refill container is not an approved refill container due to the added print substance. In some examples, a user may override a determination made by the processing resource with a user interface. For example, if a processing resource determines the refill process should not initiate a user may override the determination with a user interface and initiate the refill process.

Figure 4:
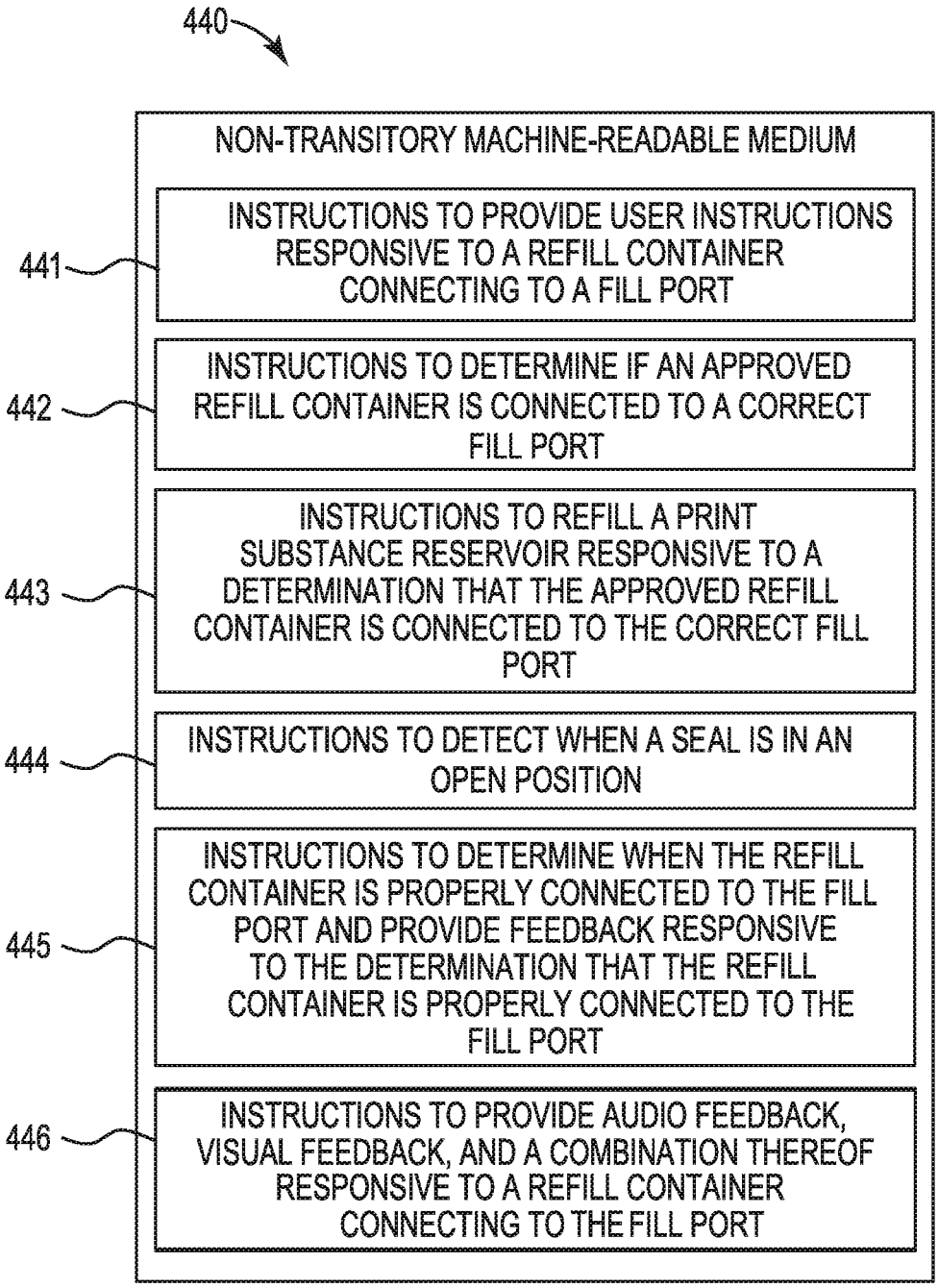
FIG. 4 illustrates an example diagram non-transitory machine-readable medium including a print substance reservoir.

FIG. 4 illustrates an example of a diagram non-transitory machine-readable medium 440 including a print substance reservoir. A processing resource may execute instructions stored on the non-transitory machine-readable medium 440. The non-transitory machine-readable medium 440 may be any type of volatile or non-volatile memory or storage, such as random-access memory (RAM), flash memory, read-only memory (ROM), storage volumes, a hard disk, or a combination thereof.

The medium 440 stores instructions 441 executable by a processing resource to provide user feedback responsive to a refill container connecting to a fill port. In some examples, providing user instructions when a refill container is connected to the fill port may inform a user if the refill container is properly connected to the fill port. In some examples, providing user instructions after a refill container connects to the fill port may prevent spilling of print substance. That is, if the refill container is not properly connected to the fill port the user will receive instructions with information on how to correct the error.

The medium 440 stores instructions 442 executable by a processing resource to determine if an approved refill container is connected to a correct fill port. That is, if it is determined that the refill container is not an approved refill container to refill the print substance reservoir, the user may receive feedback to correct the error. In some examples, after the error is corrected the refill process may initiate. In some examples, a refill container may not be an approved refill container if the refill container is not connected to the correct fill port. In this case, the user may receive feedback as to which fill port is the correct fill port for the refill container. In some examples, a refill container may not be an approved refill container if the refill container does not have an approved type of print substance. Further, a refill container may not be an approved refill container if the print substance in the refill container is expired.

The medium 440 stores instructions 443 executable by a processing resource to refill a print substance reservoir responsive to a determination that the approved refill container is connected to the correct fill port. In some examples, the refill container may be approved and the refill process may initiate if it is determined that the refill container is connected to the correct fill port to refill the print substance reservoir with the correct color, the print substance in the refill container is not expired, the print substance in the refill container is of an approved type or brand, etc. However, if the refill container is not approved the refill process will not initiate until an approved refill container is connected.

The medium 440 stores instructions 444 executable by a processing resource to detect when a seal is in an open position. In some examples, when the seal to the fill port is in an open position it may alert the printing device that a user may refill the print substance reservoir. The printing device may then provide feedback in the form of instruction to guide the user during the refill process.

The medium 440 stores instructions 445 executable by a processing resource to determine when the refill container is properly connected to the fill port and provide feedback responsive to the determination that the refill container is properly connected to the fill port. In some examples, determining when a refill container connects to the fill port may prevent print substance from spilling during the refill process. That is, the refill process may not initiate until it is determined that the refill container is properly connected, preventing transfer of print substance.

The medium 440 stores instructions 446 executable by a processing resource to provide audio feedback, visual feedback, and a combination thereof responsive to the refill container connecting to the fill port. In some examples, the audio-visual feedback may inform the user when an action has been correctly performed. In addition, audio-visual feedback may also inform a user when an action has not been performed correctly. This may allow a user to correct their mistake before continuing with the refill process. In some examples, the feedback may guide the user by providing visual feedback from a light source or display screen, and/or audio feedback from an audio mechanism.

Figure 5:
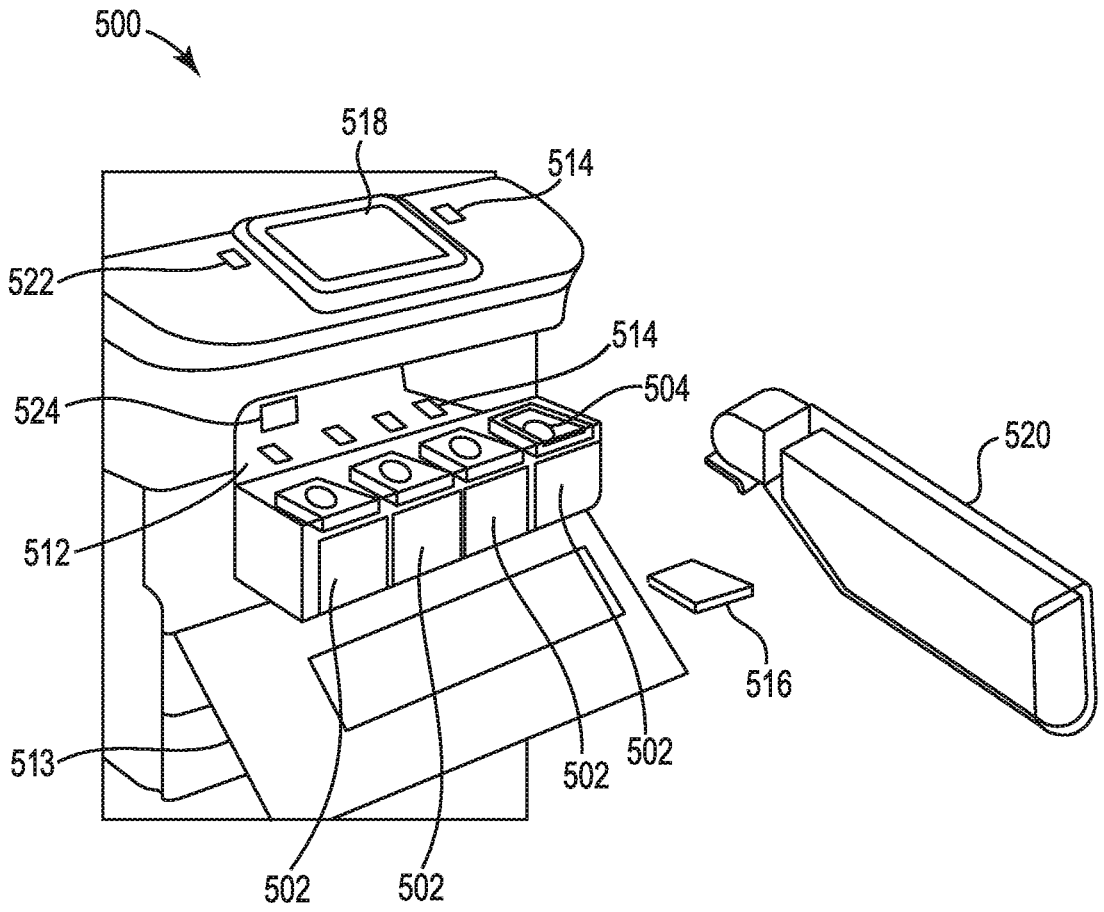
FIG. 5 illustrates an example printing device including a print substance reservoir.

FIG. 5 illustrates an example printing device 500 including a print substance reservoir 502. In some examples, the printing device 500 may include a plurality of print substance reservoirs 502. In some examples, the print substance reservoir 502 may be used to contain print substance. In some examples, the print substance reservoir 502 may include a fill port 504 coupled to the print substance reservoir 502. In some examples, each print substance reservoir 502 of the plurality of print substance reservoirs 502 is coupled to a fill port 504. In some examples, when the amount of print substance in the print substance reservoir 502 is not at capacity a refill container 520 may refill the print substance reservoir 502 with print substance during a refill process. In some examples, the print substance reservoir 502 may be housed in an enclosure 512. In some examples, the enclosure 512 may include a door 513. In some examples, the door 513 may cover the print substance reservoir 502 coupled to the fill port 504. In some examples, when the door 513 is in an open position the printing device 500 may provide a user with instructions, via an indicator, on how to refill the print substance reservoir 502. In some examples, the enclosure 512 may include an indicator such as light source 514 to provide user feedback and indicate which print substance reservoir 502 is to undergo a refill process. In some examples, a light source 514 may be positioned near each of the print substance reservoir 502 of the plurality of print substance reservoirs 502.

For example, when the amount of print substance in the print substance reservoir 502 is not at capacity the light source 514 inside the enclosure 512 may flash in a slow manner near the print substance reservoir 502 that is to undergo a refill process. In addition, the light source 514 outside the enclosure 512 may flash in a slow manner. In some examples, the printing device 500 may include an indicator such as a display screen 518 to provide user feedback and indicate which print substance reservoir 502 is to undergo a refill process. For example, the display screen 518 may display text or images to indicate which print substance reservoir 502 is to be refilled. In some examples, a user may then remove the seal 516 associated with the print substance reservoir 502 that is to undergo a refill process. In some examples, when a seal 516 is removed the printing device 500 may provide user feedback, via an indicator, to alert the user a change has occurred. For example, the light source 514 inside the enclosure 512 may flash at a rapid pace near the print substance reservoir 502 with the removed seal 516. In addition, the audio mechanism 522 may produce a repetitive sound (e.g., a beeping sound) to alert the user that the seal 516 has been removed. In some examples, the printing device 500 may include an indicator such as a display screen 518 to provide user feedback and indicate that the seal 516 has been removed. In some examples, the display screen 518 may provide instructions on how to complete the refill process (e.g., connect refill container, etc.).

In some examples, the refill container 520 may connect with the fill port 504 coupled to the print substance reservoir 502. In some examples, the printing device 500 may provide user feedback with an indicator when the refill container 520 is connected to the fill port 504. For example, a vibration mechanism 524 may provide haptic feedback, in the form of vibrations, when the refill container 520 is connected to the fill port 504. In addition, the printing device 500 may provide user feedback to inform the user when the refill container 520 is properly connected to the fill port 504.

For example, if the refill container 520 is not properly connected to the fill port 504 the vibration mechanism 524 may produce rapid haptic feedback (e.g., fast pace vibrations), the light source 514 may flash at a rapid pace, and/or the display screen 518 may provide feedback indicating that the refill container 520 is not properly connected. In some examples, the display screen 518 may provide instructions on how to correct a user error. In addition, if the refill container 520 is properly connected to the fill port 504 the vibration mechanism 524 may produce an individual instance of a vibration or haptic feedback, the light source 514 may produce a continuous light, and/or the audio mechanism 522 may produce a sound indicating that the refill container 520 is properly connected (e.g., okay, connected, ready, a beeping sound etc.). In some examples, the display screen 518 may provide feedback indicating that the refill container 520 is properly connected. In some examples, the display screen 518 may provide instructions on what to do next (e.g., lift refill container to initiate print substance transfer, etc.).

In some examples, the printing device 500 may inform a user to initiate the transfer of print substance. In some examples, the printing device 500 may automatically initiate the transfer of print substance when an approved refill container 520 is properly connected to a fill port 504. In some examples, when a transfer of print substance initiates the printing device 500 may provide user feedback via an indicator. For example, the light source 514 may produce a slow flashing light, the audio mechanism 522 may produce a sound indicating that the transfer of print substance has initiated (e.g., refilling, transferring, a beeping sound, etc.), and/or the vibration mechanism 524 may produce slow haptic feedback (e.g., slow pace vibrations).

In some examples, the printing device 500 may inform a user the transfer process is complete. In some examples, when a transfer of print substance is complete the printing device 500 may provide user feedback via an indicator. For example, the light source 514 may turn off, the audio mechanism 522 may produce a sound indicating that the transfer of print substance is complete (e.g., transfer finished, complete, full, beeping sound, etc.), and/or the haptic feedback may stop. In some examples the display screen 518 may provide feedback indicating that the transfer of print substance is complete. For example, the display screen 518 may utilize graphics and/or text to indicate that the print substance reservoir 502 is at capacity and the transfer of print substance is complete. In some examples, the display screen 518 may provide the user with instructions on how to complete the refill process (e.g., remove refill container, etc.).

In some examples, when the refill container 520 is removed the printing device 500 may use an indicator to provide user feedback. In some examples, the user feedback may alert the user to replace the seal 516. For example, the light source 514 inside the enclosure 512 may flash in at a rapid pace near the print substance reservoir 502 with the removed seal 516 until the seal 516 is replaced. In addition, the audio mechanism 522 may produce a repetitive sound indicating that the seal 516 should be replaced (e.g., words to replace seal, beeping, etc.). In some examples, the printing device 500 may include an indicator such as a display screen 518 to provide user feedback and indicate that the seal 516 should be replaced and provide instructions on how to replace the seal 516.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the disclosure. In addition, the proportion and the relative scale of the elements provided in the figures are intended to illustrate the examples of the disclosure and should not be taken in a limiting sense.

It should be understood that the descriptions of various examples may not be drawn to scale and thus, the descriptions may have a different size and/or configuration other than as shown therein.

What is claimed:

1. A printing device comprising:

a print substance reservoir to house a print substance, wherein the print substance reservoir is communicatively coupled to a fill port;

an indicator to convey information to a user;

a sensor to determine when a refill container is connected to the fill port;

a processing resource; and a non-transitory machine-readable medium storing instructions executable by the processing resource to:

transmit signals to the indicator responsive to an indication that the sensor has detected the refill container connected to the fill port, wherein the signals correspond to the information to be conveyed by the indicator; and authenticate the refill container.

2. The printing device of claim 1, wherein the indicator is to convey information to the user through haptic feedback and user instructions.

3. The printing device of claim 1, wherein a memory device included in the refill container is used to authenticate the refill container and the print substance inside the refill container.

4. The printing device of claim 3, further comprising the medium to receive a refill container information from the memory device included in the refill container responsive to the refill container connecting to the fill port.

5. The printing device of claim 4, wherein the refill container information comprises information about the print substance in the refill container.

6. A non-transitory machine-readable medium storing instructions executable by a processing resource to:

provide user instructions responsive to a refill container connecting to a fill port, wherein the user instructions include haptic feedback;

determine if an approved refill container is connected to a correct fill port; and refill a print substance reservoir responsive to a determination that the approved refill container is connected to the correct fill port.

7. The medium of claim 6, storing instructions to detect when a seal is in an open position.

8. The medium of claim 6, storing instructions to determine when the refill container is properly connected to the fill port; and provide feedback responsive to a determination that the refill container is properly connected to the fill port.

9. The medium of claim 6, storing instructions to provide audio feedback, visual feedback, and a combination thereof responsive to the refill container connecting to the fill port.

10. A method comprising:

detecting, by a processing resource, when a refill container is connected to a fill port;

receiving, by the processing resource, a refill container information from a memory device included in the refill container;

determining, by the processing resource, if a refill process should initiate;

refilling, by the processing resource, a print substance reservoir responsive to a determination that the refill process should initiate;

providing, by the processing resource, haptic feedback to convey information to a user responsive to initiation of the refill process.

11. The method of claim 10, further comprising providing feedback to convey information to the user via an audio mechanism, a visual mechanism, and a combination thereof.

12. The method of claim 11, further comprising providing written feedback, graphic feedback, and a combination thereof via a display screen.

13. The method of claim 12, further comprising displaying instructions to refill the print substance reservoir during the refill process via the display screen.

14. The method of claim 10, further comprising connecting to a network to compare the refill container information with a network information responsive to a received refill container information.

15. The method of claim 10, further comprising updating the refill container information after the transfer of print substance is completed.

* * * * *